US009881491B2

(12) United States Patent
Lang

(10) Patent No.: US 9,881,491 B2
(45) Date of Patent: Jan. 30, 2018

(54) FIRE DETECTOR COMPRISING A MOS GAS SENSOR AND A PHOTOELECTRIC DETECTOR

(75) Inventor: Scott R. Lang, Geneva, IL (US)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 882 days.

(21) Appl. No.: 13/293,665

(22) Filed: Nov. 10, 2011

(65) Prior Publication Data

US 2013/0119281 A1 May 16, 2013

(51) Int. Cl.

| | |
|---|---|
| ***G08B 29/18*** | (2006.01) |
| ***G08B 17/00*** | (2006.01) |
| ***G08B 17/10*** | (2006.01) |

(52) U.S. Cl.

CPC ..... *G08B 29/183* (2013.01); *G08B 17/00* (2013.01); *G08B 17/10* (2013.01)

(58) Field of Classification Search

CPC ..... G08B 29/183; G08B 17/00; G08B 17/06; G08B 17/10; G08B 17/103; G08B 17/107; G01N 21/53; G01N 21/532; G01N 15/0205

USPC ..... 250/221, 239, 573, 574, 575, 222.1, 250/222.2, 238, 554, 564, 339.03, 339.06, 250/393, 374; 340/630, 522, 577, 628, 340/632, 584, 521, 578, 600, 627, 634; 356/43, 44, 338, 342, 343, 218, 222; 73/31.06, 31.02, 54.42

See application file for complete search history.

(56) References Cited

U.S. PATENT DOCUMENTS

| | | | | |
|---|---|---|---|---|
| 3,922,656 | A * | 11/1975 | Horvath et al. | 340/522 |
| 4,640,628 | A | 2/1987 | Seki et al. | |
| 5,831,537 | A | 11/1998 | Marman | |
| 5,945,924 | A * | 8/1999 | Marman | G08B 17/10 340/928 |
| 6,107,925 | A * | 8/2000 | Wong | 340/628 |
| 6,241,948 | B1 * | 6/2001 | Watkins et al. | 422/82.05 |
| 6,521,907 | B1 | 2/2003 | Shoaff et al. | |
| 6,788,197 | B1 * | 9/2004 | Thuillard | G08B 17/107 340/506 |
| 6,967,582 | B2 | 11/2005 | Tice et al. | |
| 6,995,360 | B2 * | 2/2006 | Jones et al. | 250/269.1 |
| 8,013,303 | B2 * | 9/2011 | Ershov et al. | 250/339.07 |
| 8,304,850 | B2 * | 11/2012 | Lazarov | G01J 5/02 250/338.1 |
| 2004/0056765 | A1 | 3/2004 | Anderson et al. | |
| 2004/0149582 | A1 * | 8/2004 | Kovacs | 204/547 |
| 2006/0000259 | A1 | 1/2006 | Rothschild et al. | |
| 2008/0044939 | A1 * | 2/2008 | Nassiopoulou | B81C 1/00071 438/54 |
| 2008/0110241 | A1 | 5/2008 | Rothschild et al. | |
| 2010/0077840 | A1 * | 4/2010 | Srivastava et al. | 73/31.05 |
| 2011/0259080 | A1 * | 10/2011 | Ratcliffe et al. | 73/23.35 |

FOREIGN PATENT DOCUMENTS

WO 2009/135524 A1 11/2009

* cited by examiner

*Primary Examiner* — Que T Le
*Assistant Examiner* — Jennifer Bennett
(74) *Attorney, Agent, or Firm* — Husch Blackwell LLP

(57) ABSTRACT

A dual sensor fire detector includes a smoke sensor and a gas sensor. A source of radiant energy emits a primary beam that is formed into first and second beams. One beam is directed into a smoke sensing chamber. The other is directed to the gas sensor. Outputs from the smoke sensor and the gas sensor are combined to make a fire determination.

11 Claims, 1 Drawing Sheet

FIRE DETECTOR COMPRISING A MOS GAS SENSOR AND A PHOTOELECTRIC DETECTOR

FIELD

The application pertains to fire detectors. More particularly, the application pertains to such detectors that incorporate both a photoelectric smoke sensor and a solid state gas sensor.

BACKGROUND

There are several types of photoelectric smoke detectors. Most detectors use only forward scattering detectors with a light source in the near infrared. Some detectors use a dual angle sensing chamber, which measures both the forward and backward light scattered from particles in order to gain some insight into particle size.

Some detectors use more than one wavelength of light. Others use a combination of angles and wavelengths. Some detectors use a photoelectric sensing chamber combined with heat, gas, or light sensing, i.e., multi-criteria smoke detectors. One example of a photoelectric smoke sensor is disclosed in U.S. Pat. No. 6,521,907, entitled "Miniature Photoelectric Sensing Chamber," which issued Feb. 18, 2003. One example of a multi-criteria detector is disclosed in U.S. Pat. No. 6,967,582, entitled "Detector With Ambient Photon Sensor and Other Sensors," which issued Nov. 22, 2005. Both U.S. Pat. No. 6,521,907 and U.S. Pat. No. 6,967,582 are owned by the assignee hereof and incorporated herein by reference.

Photoelectric smoke sensors that use near infrared light (850 to 950 nm) are generally known to be better at detecting smoldering fires since those types of fires produce larger particles. Ionization-type smoke sensors tend to detect flaming fires better. Ionization sensing chambers are better at detecting small particles produced by the flaming fires. Ionization-based detectors are falling out of favor due to increased environmental regulations.

Smoke detectors are commercially available that use blue light emitting diodes (LED's). When blue LED's are used in forward scattering photoelectric smoke sensing chambers, a sensor's response to small particles improves. This is predicted by the Mie scattering theory, which says that particles will preferentially scatter light in the forward direction when the wavelength of light approaches the particle size. Small particles are typically produced by flaming fires.

At least some known photoelectric smoke sensors include an optic block that carries a light source, such as an LED, and a light sensitive element, such as a photodiode. The source and the light sensitive element are arranged at a prescribed angle to one another in order to detect scattered light. A housing surrounds the optic block and serves to exclude ambient light and direct the flow of ambient airborne particulate matter.

MOS (metal oxide semiconductor) gas sensors are typically heated to 200 to 400° C. for proper operation. This required heating can be achieved by using a resistance heater, causing high power consumption. Some thick film MOS gas sensors draw up to 500 mW, while thin film or MEMS devices may draw an order of magnitude less. This high power consumption limits the number of applications where they can be used. For example, system connected fire detectors require low power consumption due to battery backup requirements in the National Fire Alarm Code.

MOS gas sensors also tend to not be selective to one gas, but sensitive to a whole class of gases, e.g., oxidizing gases. Radiant energy can be directed onto such sensors to increase their sensitivity instead of heating them. Doing so reduces the amount of power required to operate them.

DETAILED DESCRIPTION

Figure 1:
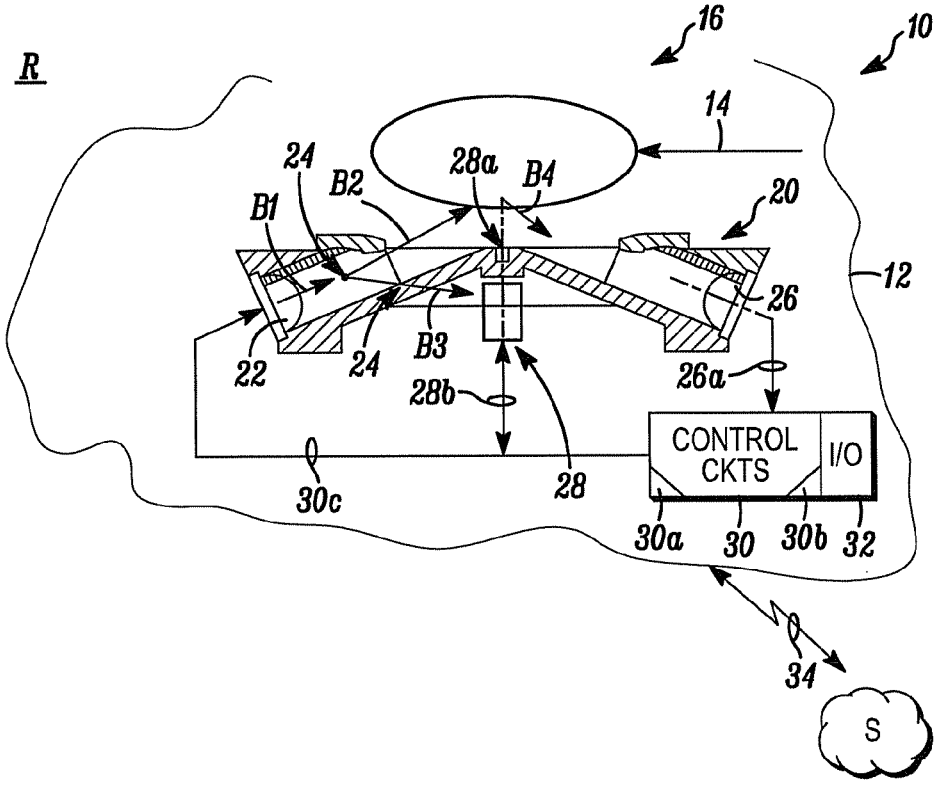
FIG. 1 is a block diagram of a multi-sensor fire detector in accordance herewith.

While disclosed embodiments can take many different forms, specific embodiments hereof are shown in the drawings and will be described herein in detail with the understanding that the present disclosure is to be considered as an exemplification of the principles hereof as well as the best mode of practicing the same and is not intended to limit the claims hereof to the specific embodiment illustrated.

In one aspect hereof, a smoke sensing chamber includes a blue or UV light source where the light source is used not only for measuring particles of smoke with light scattering, but also enhancing the operation of an MOS gas sensor. Flaming fires can be detected if the gas sensor oxide is chosen to be $WO_3$ for $NO_2$ detection since flaming fires produce $NO_2$. Alternately, if $SnO_2$ is chosen for the oxide to sense CO, then both smoldering and flaming fires could be detected.

Light or radiant energy from the light source is directed in two directions such that it creates the necessary scattering volume for the smoke sensing chamber, for example, a photoelectric sensing chamber, and it shines on the MOS gas sensor's gas sensitive oxide in order to enhance operation thereof. In another aspect, the light source can be intermittently activated to reduce power requirements. In an alternate embodiment, two different sources, activated intermittently, could be used.

Radiant energy from the source can be divided into beams. One beam can be directed into the scattering volume. The other can be directed at the gas sensor.

An optical or mechanical element can be used to form two different beams. One optical element is a beam splitter. Wavelengths for the emitted radiant energy can range from blue (465 nanometers) to ultraviolet (365 nanometers).

The MOS gas sensor may be heated, but at a lower level than is ordinarily required or not heated at all. The gas sensor may be occasionally heated in order to clean the sensor and restore it to a baseline condition. Advantageously, various different oxides may be used in the MOS gas sensor, including tin oxide, tungsten oxide, chrome titanium oxide, etc., depending on what gases need to be sensed.

Figure 2:
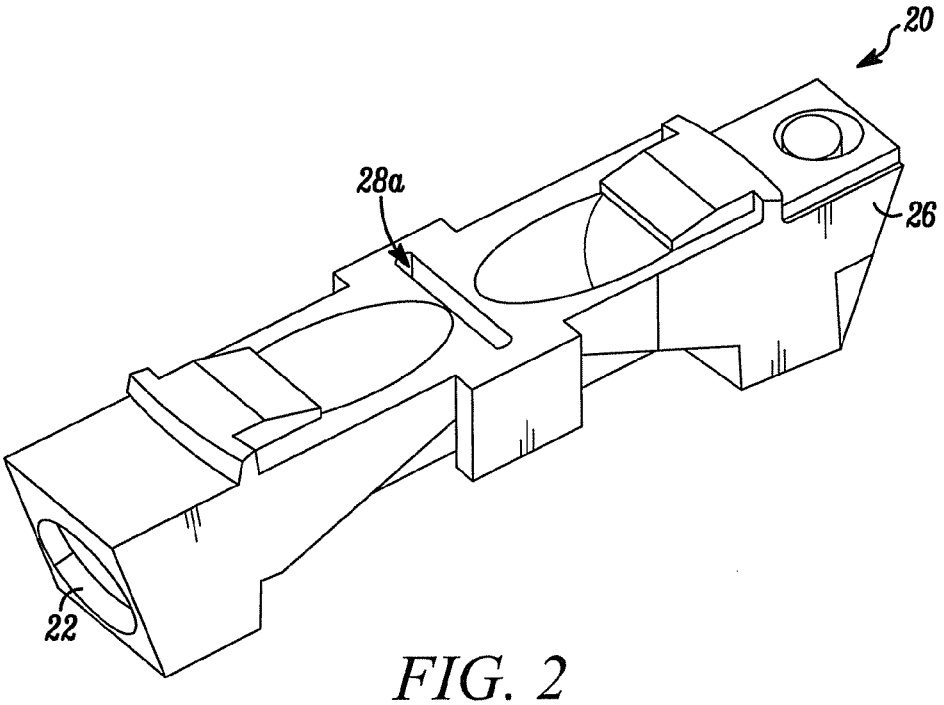
FIG. 2 is an enlarged perspective view of a mounting block usable in the detector of FIG. 1.

FIGS. 1 and 2 illustrate various aspects of an exemplary dual sensor fire detector 10 in accordance herewith. The detector 10 can be carried in a housing 12 that defines an internal scattering volume 14. The housing 12 defines openings 16, as would be understood by those of skill in the art, to provide for ingress of ambient airborne particulate matter, for example, smoke from a fire in an adjacent region R being monitored by the detector 10 and gases produced by such fire.

The housing 12 also carries a mounting or optical block 20. The block 20, in turn, carries a source of radiant energy 22, such as a blue emitting LED or a laser with a wavelength in a range as discussed above. The source 22 emits radiant energy as a beam B1 directed to a divider element 24. The divider element 24, which could be mechanical or optical, such as a beam splitter, forms two different beams B2, B3.

The beam B2 is directed into the scattering volume 14. Light scattered by airborne smoke particulate, indicated generally as B4, is incident on a photosensor 26.

The beam B3 is incident on a metal oxide gas sensor 28 and activates that sensor to respond to gases that enter the housing 12 via a pathway 28*a* and are incident on the sensor 28 as discussed above.

Control circuits 30 carried by housing 12 could be implemented, in part, by a programmable processor 30*a* that executes pre-stored control circuitry 30*b* present in a non-transitory computer readable storage medium. The control circuits 30 are coupled to the source 22 to activate the same via a conductor 30*c*.

The control circuits 30 receive gas indicating signals via a conductor 28*b* and smoke indicating signals via a conductor 26*a*. Signals on the lines 28*b* and 26*a* can be processed to make a fire determination.

Input/output interface circuits 32 coupled to the control circuits 30 communicate with a displaced alarm system S via a wired or wireless medium 34.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

Further, logic flows depicted in the figures do not require the particular order shown or sequential order to achieve desirable results. Other steps may be provided, steps may be eliminated from the described flows, and other components may be add to or removed from the described embodiments.

The invention claimed is:

1. A fire detector comprising:

a mounting block;

a source of radiant energy carried on a first side of the mounting block;

a beam splitter that splits a beam generated by the source of the radiant energy into a first portion and a second portion for a dual analysis of an air sample;

a photoelectric detector carried on a second side of the mounting block;

a radiant energy scattering region;

a metal oxide semiconductor carried on the mounting block between the source of the radiant energy and the photoelectric detector; and a solid state gas sensor region, wherein the first portion of the radiant energy is directed into the radiant energy scattering region, and the second portion of the radiant energy is directed at the metal oxide semiconductor, thereby activating the metal oxide semiconductor using the second portion of the radiant energy.

2. The fire detector as in claim 1 further comprising a housing for the source of the radiant energy, the radiant energy scattering region, and the solid state gas sensor region, wherein openings defined in the housing couple ambient atmosphere into the radiant energy scattering region.

3. The fire detector as in claim 2 further comprising a passageway coupling the ambient atmosphere onto the solid state gas sensor region.

4. The fire detector as in claim 1 wherein the source of the radiant energy comprises one of a light emitting diode or a laser.

5. The fire detector as in claim 1 further comprising a heater for the metal oxide semiconductor.

6. The fire detector as in claim 1 wherein the beam splitter comprises an optical former of the first portion and the second portion or a mechanical former of the first portion and the second portion.

7. The fire detector as in claim 1 further comprising control circuits to activate the source of the radiant energy, at least intermittently.

8. The fire detector as in claim 7 wherein the control circuits include a heater for the metal oxide semiconductor, and wherein the control circuits activate the heater, at least intermittently.

9. A multi-sensor fire detector comprising:

a mounting block;

at least one source of radiant energy carried on a first side of the mounting block;

a beam splitter that splits a primary beam generated by the at least one source of the radiant energy into a first portion and a second portion;

a photoelectric detector carried on a second side of the mounting block;

a radiant energy scattering region, wherein the first portion of the radiant energy is directed into the radiant energy scattering region;

a metal oxide semiconductor carried on the mounting block between the source of the radiant energy and the photoelectric detector;

a solid state gas sensor region comprising the metal oxide semiconductor and a heater, wherein the at least one source of the radiant energy comprises one of a light emitting diode or a laser, and wherein the second portion of the radiant energy is directed at the metal oxide semiconductor, thereby activating the metal oxide semiconductor using the second portion of the radiant energy; and control circuits to activate the at least one source of the radiant energy, at least intermittently, and to receive signals from the metal oxide semiconductor and the photoelectric detector.

10. The multi-sensor fire detector as in claim 9 further comprising an element to form first and second beams of the radiant energy.

11. A method of fire detection comprising:

mounting a light emitting diode on a first side of a mounting block;

mounting a photoelectric detector on a second side of the mounting block;

mounting a metal oxide semiconductor on the mounting block between the light emitting diode and the photoelectric detector;

the light emitting diode providing a primary beam of radiant energy;

splitting the primary beam of the radiant energy to forma first beam and a second beam via a mechanical element or an optical element;

directing the first beam to a scattering photoelectric sensor chamber comprising the photoelectric detector and the second beam to a metal oxide semiconductor gas sensor region comprising the metal oxide semiconductor, wherein the second beam is directed at the metal oxide semiconductor to activate the metal oxide semiconductor using the radiant energy of the second beam;

forming electrical signals indicative of sensed scattering and sensed gas; and evaluating the electrical signals for a presence of fire, wherein the primary beam of the radiant energy and the photoelectric detector are arranged at a prescribed angle relative to one another in order to detect scattered light.

* * * * *